US006539734B1

(12) United States Patent
Weyna

(10) Patent No.: US 6,539,734 B1
(45) Date of Patent: Apr. 1, 2003

(54) METHOD AND APPARATUS FOR DETECTING FLOODED START IN COMPRESSOR

(75) Inventor: Paul Valentine Weyna, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/013,074

(22) Filed: Dec. 10, 2001

(51) Int. Cl.[7] ..... F25B 41/04; F25B 49/00
(52) U.S. Cl. ..... 62/126; 62/217; 62/228.3
(58) Field of Search ..... 62/126, 217, 228.1, 62/228.5, 157, 228.3; 417/18, 19

(56) References Cited

U.S. PATENT DOCUMENTS 4,788,826 A * 12/1988 Higdon ..... 62/126
5,209,076 A * 5/1993 Kaufman et al. ..... 62/126
5,666,815 A * 9/1997 Aloise ..... 62/129
5,761,918 A * 6/1998 Jackson et al. ..... 62/181
6,017,192 A * 1/2000 Clack et al. ..... 417/18

* cited by examiner

*Primary Examiner*—Denise L. Esquivel
*Assistant Examiner*—Marc Norman
(74) *Attorney, Agent, or Firm*—Wall Marjama & Bilinski LLP

(57) ABSTRACT

When a flooded compressor in a refrigeration unit begins to run, refrigerant that has been absorbed into the oil is suddenly released, causing the crankcase to be filled with a sudsy mixture of refrigerant and oil. This mixture is then drawn into the suction manifold, cylinders, and compressor heads, in addition to being pumped out into the refrigeration system. When a flooded compressor startup condition in a mobile refrigeration unit is sensed, the compressor is shut down for a specified period of time to allow the oil in the system and on the compressor heads to drain back into the compressor oil sump before running the compressor again. The flooded compressor condition is determined by checking whether a suction superheat, a discharge superheat, and a suction pressure are all within specified operating parameters for a specified period of time after the compressor is started.

18 Claims, 2 Drawing Sheets

METHOD AND APPARATUS FOR DETECTING FLOODED START IN COMPRESSOR

FIELD OF THE INVENTION

This invention relates generally to the field of refrigeration unit compressors, and more particularly to a refrigeration unit compressor which becomes flooded when not operated for a period of time.

BACKGROUND OF THE INVENTION

It is commonly known that, in a refrigeration system, starting any compressor with its crankcase filled with liquid refrigerant causes premature wear or failure of some compressor components, such as the suction and discharge valves, the thrust washer, the piston/rod assembly, the connecting rod bearing, and the main bearing. The problem arises because the oil that lubricates the compressor parts becomes saturated with the refrigerant in the system during extended periods when the system is not operating. A way of preventing damage caused by a flooded start is needed.

SUMMARY OF THE INVENTION

Briefly stated, when a flooded compressor in a refrigeration unit begins to run, refrigerant that has been absorbed into the oil is suddenly released, causing the crankcase to be filled with a sudsy mixture of refrigerant and oil. This mixture is then drawn into the suction manifold, cylinders, and compressor heads, in addition to being pumped out into the refrigeration system. When a flooded compressor startup condition in a mobile refrigeration unit is sensed, the compressor is shut down for a specified period of time to allow the oil in the system and on the compressor heads to drain back into the compressor oil sump before running the compressor again. The flooded compressor condition is determined by checking whether a suction superheat, a discharge superheat, and a suction pressure are all within specified operating parameters for a specified period of time after the compressor is started.

According to an embodiment of the invention, a method for detecting a flooded compressor startup condition in a mobile refrigeration unit includes the steps of (a) determining whether the compressor is running, and if so, starting a timer; (b) determining, after the timer is started, whether a discharge superheat of the unit is less than a first predetermined temperature, and if so, determining whether a suction superheat of the unit is less than a second predetermined temperature, and if so, determining whether a suction pressure of the unit exceeds a predetermined pressure, and if so, determining whether the timer exceeds a first predetermined period of time; (c) determining, after step (b) is completed and after the timer exceeds the first predetermined time, whether the suction superheat is less than the second predetermined temperature, and if so, determining whether the discharge superheat is less than the first predetermined temperature, and if so, determining whether the timer exceeds a second predetermined period of time; and (d) stopping, after step (c) is completed and after the timer exceeds the second predetermined period of time, the compressor.

According to an embodiment of the invention, a method for detecting a flooded compressor startup condition in a mobile refrigeration unit includes determining whether a suction superheat of the unit, a discharge superheat of the unit, and a suction pressure of the unit are all within specified operating parameters for a first specified period of time after the compressor is started, and if so, stopping the compressor for at least a second specified period of time.

According to an embodiment of the invention, an apparatus for detecting a flooded compressor startup condition in a mobile refrigeration unit includes means for determining whether the compressor is running, and if so, starting a timer; means for determining, after the timer is started, whether a discharge superheat of the unit is less than a first predetermined temperature, and if so, determining whether a suction superheat of the unit is less than a second predetermined temperature, and if so, determining whether a suction pressure of the unit exceeds a predetermined pressure, and if so, determining whether the timer exceeds a first predetermined period of time; means for determining whether the suction superheat is less than the second predetermined temperature after the timer exceeds the first predetermined time, and if so, determining whether the discharge superheat is less than the first predetermined temperature, and if so, determining whether the timer exceeds a second predetermined period of time; and means for stopping the compressor after the timer exceeds the second predetermined period of time.

According to an embodiment of the invention, an apparatus for detecting a flooded compressor startup condition in a mobile refrigeration unit includes means for determining whether a suction superheat of the unit, a discharge superheat of the unit, and a suction pressure of the unit are all within specified operating parameters for a first specified period of time after the compressor is started, and if so, means for stopping the compressor for at least a second specified period of time.

DETAILED DESCRIPTION OF THE PREFERRED EMBODIMENT

Figure 1:
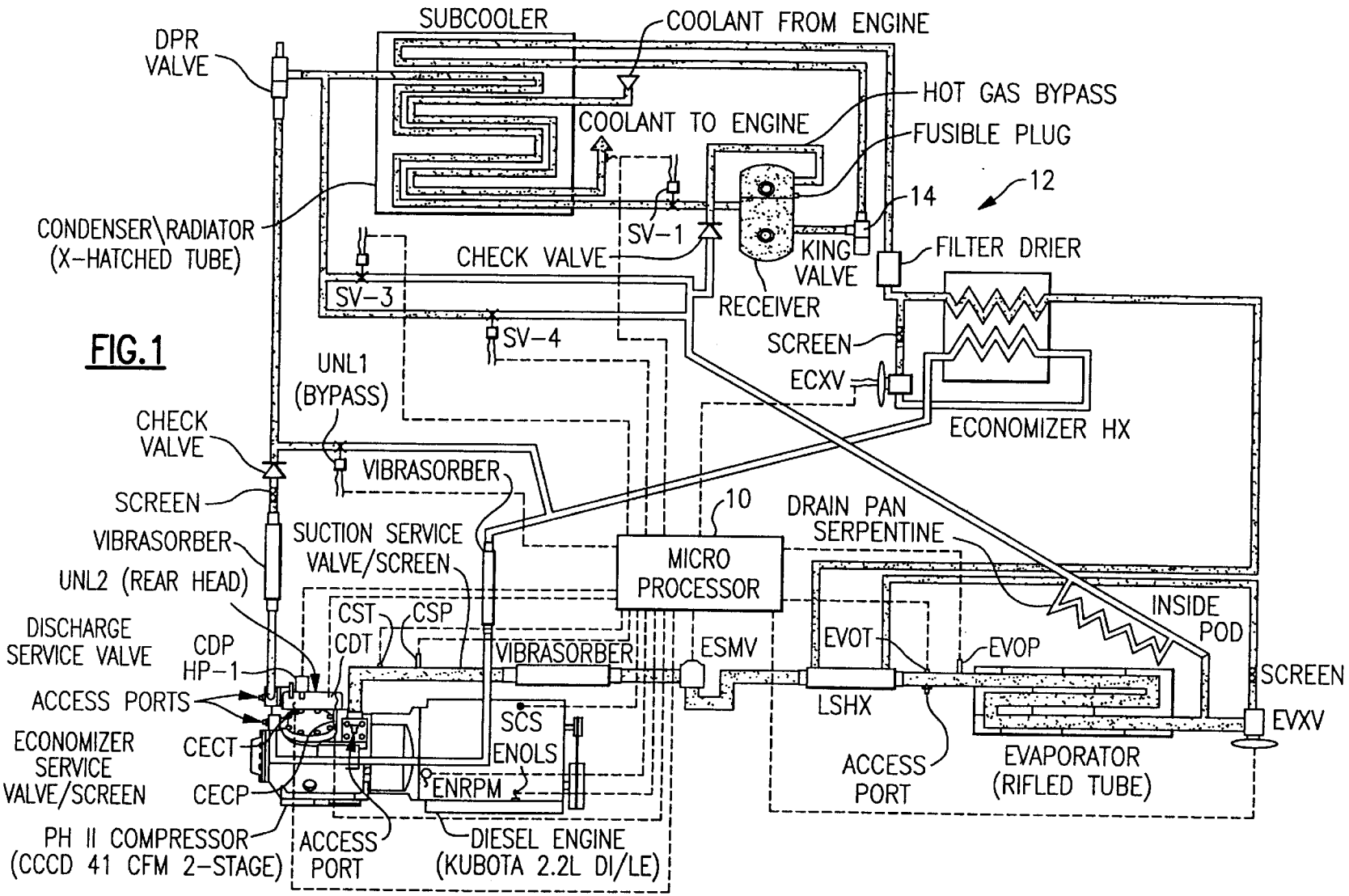
FIG. 1 shows a system schematic of a mobile refrigeration unit.

Referring to FIG. 1, a system schematic of a mobile refrigeration unit 12 is shown. Mobile units use the same conventional refrigeration cycle as other units, but with modifications that provide greater cooling capacity with a smaller physical structure than is generally obtained in stationary units. The following abbreviations are used in FIG. 1.

| | |
|---|---|
| DPR | discharge pressure regulator |
| SV | solenoid valve |
| ECXV | economizer expansion valve |
| HX | heat exchanger |
| UNL | unloader |
| CDP | compressor discharge pressure |
| HP | high pressure switch |
| CDT | compressor discharge temperature |
| CST | compressor suction temperature |
| CSP | compressor suction pressure |
| CECT | compressor economizer temperature |
| CECP | compressor economizer pressure |
| ESMV | electronic suction modulation valve |
| LSHX | liquid to suction heat exchanger |
| EVOT | evaporator outlet temperature |

-continued

| | |
|---|---|
| EVOP | evaporator outlet pressure |
| EVXV | evaporator expansion valve |
| ENRPM | engine RPM |
| ENOLS | engine oil level switch |

The various sensors and valves are connected to a microprocessor 10. When the system is not operated for an extended period of time, compressor lubrication oil mixes with the refrigerant and collects in the compressor. When a flooded compressor begins to run, the oil separates out from the refrigerant and is thrown out to the system and the compressor heads.

Figure 2:
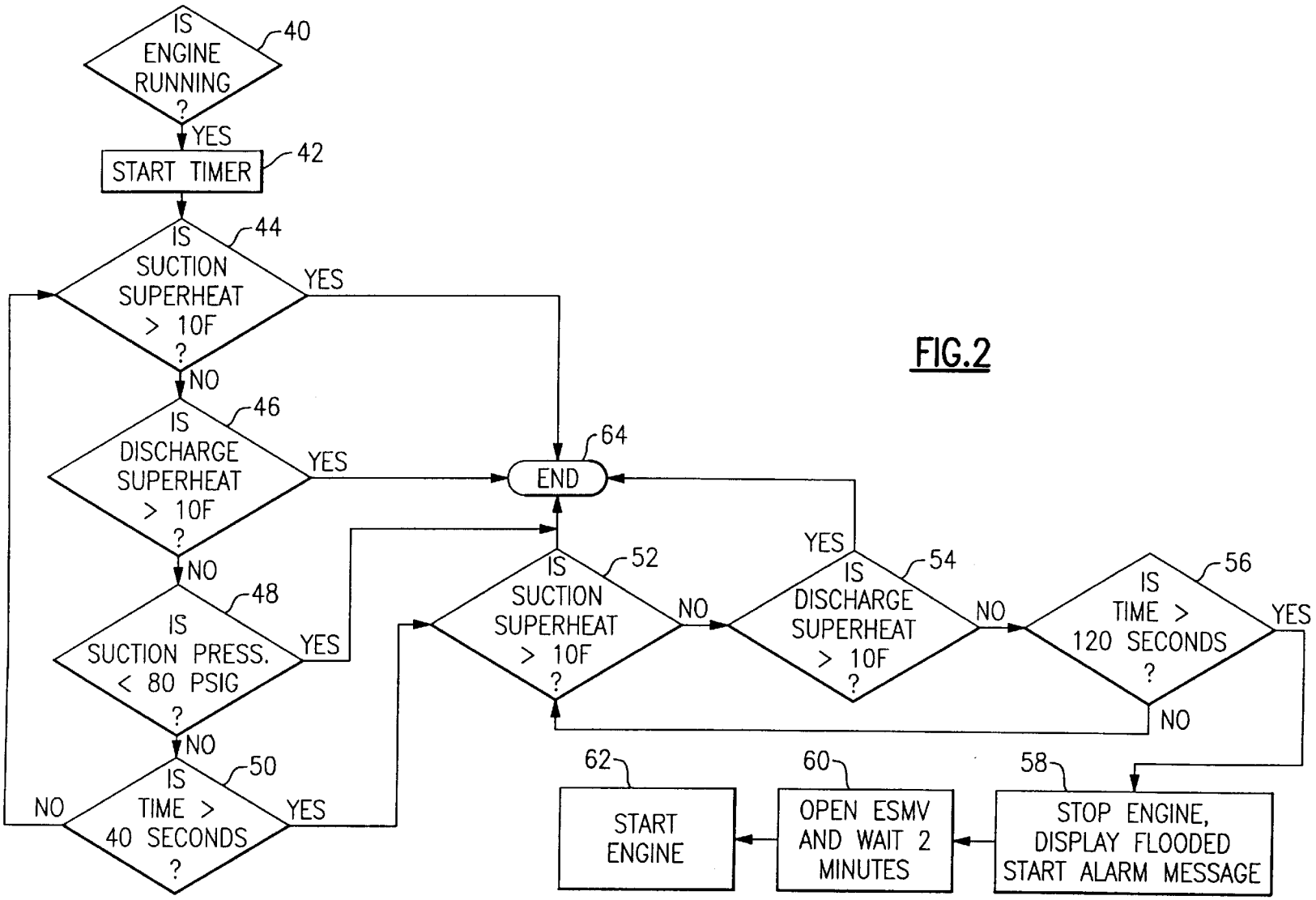
FIG. 2 shows an embodiment of a method of the invention.

Referring to FIG. 2, an embodiment of a method of the invention is shown. The present invention senses a flooded compressor startup condition and shuts down the compressor a specified period of time to allow the oil in the system and on the compressor heads to drain back into the compressor oil sump. After a specified interval, the compressor is restarted.

In step 40, the system determines if the compressor engine is running. Although a diesel engine is shown in the figure, some compressors are electrically driven by batteries or fuel cells. The present invention is equally applicable to electrically driven engines, and also to compressors that aren't powered by a dedicated engine. If the compressor or engine is running, a timer is started in step 42. The suction superheat is checked in step 44 to see if it is outside its normal range. If it is outside its normal range, the discharge superheat is checked in step 46. If the discharge superheat is outside its normal range, the suction pressure is checked in step 48. If the suction pressure is outside its normal range, then the timer is checked in step 50 to see if a first predetermined time has elapsed. If not, steps 44 through 50 are performed again. Once the first predetermined time has elapsed, the system again checks the suction superheat in step 52 and the discharge superheat in step 54. If both the suction superheat and discharge superheat remain outside their normal ranges for a second predetermined time, the compressor is flooded. The engine and/or compressor is stopped in step 58, and an alarm message is preferably sent to an operator. The alarm message can be displayed visually or sounded as a tone or series of tones. The electronic suction modulation valve is opened in step 60 for a third predetermined time to allow the separated oil to drain back into the compressor oil sump. The engine and/or compressor is then restarted in step 62.

If the discharge superheat, suction superheat, or suction pressure are within their normal operating parameters in steps 44, 46, 48, 52, and 54, a flooded compressor is not present and the system ends the routine in step 64.

The discharge superheat is defined as the actual discharge temperature (from CDT) minus the saturated discharge temperature. The suction superheat is defined as the actual suction temperature (from CST) minus the saturated suction temperature. Both the saturated discharge temperature and the saturated suction temperatures are values derived from information provided by the refrigerant manufacturers for their products. Microprocessor 10 (FIG. 1) carries out whatever calculations are necessary. The method shown in FIG. 2 is preferably programmed as software into microprocessor 10, but is optionally programmed as hardware or as a combination of hardware and software (firmware).

The times, temperatures, and pressures shown in FIG. 2 are derived from testing the system shown in FIG. 1. The times, temperatures, and pressures for other systems can be determined by one skilled in the art without undue experimentation.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for detecting a flooded compressor startup condition in a mobile refrigeration unit, comprising the steps of:

(a) determining whether said compressor is running, and if so, starting a timer;

(b) determining, after said timer is started, whether a discharge superheat of said unit is less than a first predetermined temperature, and if so, determining whether a suction superheat of said unit is less than a second predetermined temperature, and if so, determining whether a suction pressure of said unit exceeds a predetermined pressure, and if so, determining whether said timer exceeds a first predetermined period of time;

(c) determining, after step (b) is completed and after said timer exceeds said first predetermined time, whether said suction superheat is less than said second predetermined temperature, and if so, determining whether said discharge superheat is less than said first predetermined temperature, and if so, determining whether said timer exceeds a second predetermined period of time; and (d) stopping, after step (c) is completed and after said timer exceeds said second predetermined period of time, said compressor.

2. A method according to claim 1, further comprising the step of signaling, after the step of stopping said compressor, a flooded start alarm to an operator.

3. A method according to claim 2, wherein said flooded start alarm is signaled to said operator by displaying a message on a display screen.

4. A method according to claim 2, wherein said flooded start alarm is signaled to said operator by at least one audible sound.

5. A method according to claim 2, further comprising the steps of:

opening an electronic suction modulation valve after said compressor is stopped; and restarting said compressor after said electronic suction modulation valve is opened for a third predetermined period of time.

6. A method according to claim 1, further comprising the steps of:

opening an electronic suction modulation valve after said compressor is stopped; and restarting said compressor after said electronic suction modulation valve is opened for a third predetermined period of time.

7. A method for detecting a flooded compressor startup condition in a mobile refrigeration unit comprising the steps of determining whether a suction superheat of said unit, a discharge superheat of said unit, and a suction pressure of said unit are all within specified operating parameters for a first specified period of time after said compressor is started, and if so, stopping said compressor for at least a second specified period of time.

8. A method according to claim 7, further comprising the steps of:

opening, after said compressor is stopped, a valve to permit oil mixed with refrigerant in said compressor to drain from said compressor; and restarting said compressor after said second specified period of time.

9. A method according to claim 7, further comprising the step of signaling, after stopping said compressor, a flooded start alarm to an operator.

10. An apparatus for detecting a flooded compressor startup condition in a mobile refrigeration unit comprising:

means for determining whether said compressor is running, and if so, starting a timer;

means for determining, after said timer is started, whether a discharge superheat of said unit is less than a first predetermined temperature, and if so, determining whether a suction superheat of said unit is less than a second predetermined temperature, and if so, determining whether a suction pressure of said unit exceeds a predetermined pressure, and if so, determining whether said timer exceeds a first predetermined period of time;

means for determining whether said suction superheat is less than said second predetermined temperature after said timer exceeds said first predetermined time, and if so, determining whether said discharge superheat is less than said first predetermined temperature, and if so, determining whether said timer exceeds a second predetermined period of time; and means for stopping said compressor after said timer exceeds said second predetermined period of time.

11. An apparatus according to claim 10, further comprising signaling means for signaling a flooded start alarm to an operator when said compressor is stopped.

12. An apparatus according to claim 11, wherein said signaling means includes means for displaying a message on a display screen.

13. An apparatus according to claim 11, wherein said signaling means includes means for generating at least one audible sound.

14. An apparatus according to claim 11, further comprising:

means for opening an electronic suction modulation valve after said compressor is stopped; and means for restarting said compressor after said electronic suction modulation valve is opened for a third predetermined period of time.

15. An apparatus according to claim 10, further comprising:

means for opening an electronic suction modulation valve after said compressor is stopped; and means for restarting said compressor after said electronic suction modulation valve is opened for a third predetermined period of time.

16. An apparatus for detecting a flooded compressor startup condition in a mobile refrigeration unit comprising means for determining whether a suction superheat of said unit, a discharge superheat of said unit, and a suction pressure of said unit are all within specified operating parameters for a first specified period of time after said compressor is started, and if so, means for stopping said compressor for at least a second specified period of time.

17. An apparatus according to claim 16, further comprising:

means for opening, after said compressor is stopped, a valve to permit oil mixed with refrigerant in said compressor to drain from said compressor; and means for restarting said compressor after said second specified period of time.

18. An apparatus according to claim 16, further comprising means for signaling, when said compressor is stopped, a flooded start alarm to an operator.

* * * * *